US005211684A

United States Patent [19]

Shannon et al.

[11] Patent Number: 5,211,684

[45] Date of Patent: May 18, 1993

[54] CATALYST CONTAINING SMOKING ARTICLES FOR REDUCING CARBON MONOXIDE

[75] Inventors: Michael D. Shannon, Lewisville, N.C.; Richard L. Lehman, Belle Mead, N.J.; James L. Resce, Yadkinville; Olivia P. Furin, Clemmons, both of N.C.; Joseph T. Meers, Fairview Park, Ohio; Dennis M. Riggs, Belews Creek; Ernest G. Farrier, Winston-Salem, both of N.C.

[73] Assignee: R. J. Reynolds Tobacco Company, Winston-Salem, N.C.

[21] Appl. No.: 296,539

[22] Filed: Jan. 10, 1989

[51] Int. Cl.[5] ..... A24B 15/10; A24B 15/16

[52] U.S. Cl. ..... 131/352; 131/353; 131/359; 131/369; 131/194; 44/520; 44/521; 44/535

[58] Field of Search ..... 131/352, 353, 334, 359, 131/369, 194, 196; 44/520, 521, 522, 14, 531, 532, 535

[56] References Cited

U.S. PATENT DOCUMENTS

| | | |
|---|---|---|
| 1,435,504 | 5/1939 | Wald . |
| 3,338,246 | 4/1974 | Mays . |
| 3,368,566 | 2/1968 | Avedikian . |
| 3,410,276 | 7/1965 | Armbrust, Jr. et al. . |
| 3,945,945 | 3/1976 | Kiovsky et al. . |
| 4,079,742 | 3/1978 | Rainer et al. . |
| 4,142,534 | 3/1979 | Branti . |
| 4,177,822 | 12/1979 | Bryant, Jr. et al. . |
| 4,182,348 | 1/1988 | Seehofer et al. . |
| 4,215,708 | 8/1980 | Bron . |
| 4,233,189 | 11/1980 | Gandhi et al. . |
| 4,258,730 | 3/1981 | Tsukamoto . |
| 4,317,460 | 3/1982 | Dale et al. . |
| 4,397,321 | 8/1983 | Stuetz . |
| 4,532,228 | 7/1985 | Golino et al. . |
| 4,534,371 | 8/1985 | White . |
| 4,589,428 | 5/1986 | Keritsis . |
| 4,714,082 | 12/1987 | Banerjee et al. . |
| 4,756,318 | 7/1988 | Clearman et al. . |
| 4,762,567 | 8/1988 | Retallick . |
| 4,771,029 | 9/1988 | Pereira et al. . |
| 5,040,551 | 8/1991 | Schlatter ..... 131/359 |

FOREIGN PATENT DOCUMENTS

| | | |
|---|---|---|
| 859124 | 12/1970 | Canada . |
| 0174645 | 6/1986 | European Pat. Off. . |
| 0212234 | 3/1987 | European Pat. Off. . |
| 299803 | 1/1989 | European Pat. Off. . |
| 124835 | 11/1986 | Japan . |
| 781539 | 4/1987 | United Kingdom . |

OTHER PUBLICATIONS

Oxides and Hydorxides of Aluminum; Alcoa Technical Paper No. 19, Revised; Wafer, et al. Alcoa Laboratories, 1987.

*Primary Examiner*—V. Millin
*Assistant Examiner*—J. Doyle
*Attorney, Agent, or Firm*—Grover M. Myers; David G. Conlin

[57] ABSTRACT

The present invention is directed to cigarettes and other smoking articles which contain a catalytic composition, preferably as part of the fuel element, that substantially decreases the amount of carbon monoxide contained in the mainstream smoke during smoking. The present invention also relates to the catalyst-containing carbonaceous fuels themselves, as well as to methods of making such carbonaceous fuels. Fuel elements which contain a catalytic composition in accordance with the presentation are especially useful in smoking articles having an aerosol generating means which is physically separate from the fuel element.

106 Claims, 1 Drawing Sheet

CATALYST CONTAINING SMOKING ARTICLES FOR REDUCING CARBON MONOXIDE

BACKGROUND OF THE INVENTION

The present invention relates to cigarettes and other smoking articles which contain a catalytic composition, preferably as part of the fuel element, that substantially decreases the amount of carbon monoxide contained in the mainstream smoke during smoking. The present invention also relates to the catalyst-containing carbonaceous fuels themselves, as well as to methods of making such carbonaceous fuels. Fuel elements which contain a catalytic composition in accordance with the present invention are especially useful in smoking articles having an aerosol generating means which is physically separate from the fuel element.

Preferred smoking articles of the present invention are capable of providing the user with the pleasures of smoking (e.g., smoke taste, feel, satisfaction, pleasure, and the like), by heating but not burning tobacco, and with reduced levels of carbon monoxide. As used herein, the term "smoking article" includes cigarettes, cigars, pipes, and the like, which use tobacco in various forms.

Cigarettes, cigars and pipes are popular forms of tobacco smoking articles. Many smoking products and smoking articles have been proposed through the years as improvements upon, or as alternatives to, these popular forms of tobacco smoking articles, particularly cigarettes.

Many, for example, have proposed tobacco substitute smoking materials. See, e.g., U.S. Pat. No. 4,079,742 to Rainer et al. Two such materials, Cytrel and NSM, were introduced in Europe in the 1970's as partial tobacco replacements, but did not realize any long-term commercial success.

Many others have proposed smoking articles, especially cigarette smoking articles, based on the generation of an aerosol or a vapor.

Recently, in European Patent Publication Nos. 0174645 and 0212234, U.S. Pat. No. 4,714,082 to Banerjee et al. and U.S. Pat. No. 4,756,318 to Shannon et al., assigned to R.J. Reynolds Tobacco Co., there are described cigarette smoking articles which are capable of providing the user with the pleasures associated with smoking, by heating but not burning tobacco and without producing appreciable quantities of incomplete combustion or pyrolysis products. One such smoking article, the Premier TM brand cigarette, was recently introduced in the United States by the R.J. Reynolds Tobacco Co. The mainstream smoke of that cigarette typically contains about 9 to 12 mg of carbon monoxide (CO) per cigarette. See the monograph "Chemical and Biological Studies, New Cigarette Prototypes That Heat Instead of Burn Tobacco," published by the R.J. Reynolds Tobacco Co., at pages 126–127 (hereinafter "RJR Monograph").

Several attempts have been made at using catalysts and/or other modifying methods for decreasing the levels of carbon monoxide in tobacco (or tobacco substitute) smoke. However, apparently none of these techniques has met with any substantial commercial success.

U.S. Pat. No. 4,397,321 to Stuetz proposes tobacco and non-tobacco smoking compositions which contain a catalyst composition consisting of a fine ash and a transition metal compound, especially oxides of manganese or iron. This patent also describes several previous attempts at incorporating catalysts into cigarettes to decrease levels of selected smoke constituents.

U.S. Pat. No. 4,182,348 to Seehofer et al., proposes a method for removing nitric oxide and carbon monoxide from the tobacco smoke of cigarettes by adding a ruthenium compound having a perovskite structure ($M_2M'RuO_6$) to the cigarette.

U.S. Pat. No. 3,368,566 to Avedikian proposed a filter containing catalytic oxides, such as manganese dioxide, chromium trioxide and other oxides of chromium and copper to convert carbon monoxide to carbon dioxide.

U.S. Pat. No. 4,317,460 to Dale et al., proposes the use of microporous supported, low temperature catalysts in cigarette filters for the oxidation of carbon monoxide to carbon dioxide. Dale also refers to prior unsatisfactory attempts of Eastman Chemical Products Inc. to incorporate various oxidants and catalysts into filters to convert carbon monoxide to carbon dioxide.

U.S. Pat. No. 4,215,708 to Bron, describes a novel cigarette holder with a catalytic afterburner which is intended to convert carbon monoxide and incompletely burned hydrocarbons into acceptable smoke compounds.

Non-catalytic methods for decreasing the levels of carbon monoxide in cigarette smoke have also been attempted. See inter alia. U.S. Pat. No. 4,589,428 to Keritsis (extraction of tobacco), U.S. Pat. No. 4,142,534 to Branti (use of tobaccoless region), and U.S. Pat. No. 4,258,730 to Tuskamoto (use of magnetic field).

SUMMARY OF THE INVENTION

In general, the present invention relates to cigarettes and other smoking articles which contain a catalytic composition, preferably as part of a fuel element, which substantially decreases the amount of carbon monoxide in the mainstream smoke of the smoking article.

As used herein, "a substantial decrease in the amount of carbon monoxide" means a decrease in the amount of carbon monoxide in the mainstream smoke of the smoking article of at least about 30%, preferably at least about 50%, and most preferably at least about 70%, as compared with a similar smoking article having no catalytic composition, as measured by the technique described in the above referenced RJR Monograph, the disclosure of which is hereby incorporated by reference herein.

The present invention also relates to catalyst-containing fuel elements for use in smoking articles which substantially reduce the amount of carbon monoxide produced by burning such elements, as well as to methods of making such fuel elements.

Preferably, the smoking articles utilizing such fuel elements include a pressure formed carbonaceous fuel element; a physically separate aerosol generating means including an aerosol forming material, attached to one end of said fuel element; a mass of tobacco; and a mouthend piece, attached to the aerosol generating means. Examples of such smoking articles are described in the above-referenced European Patent Publication Nos. 0174645 and 0212234, U.S. Pat. No. 4,714,082 to Banerjee et al. and U.S. Pat. No. 4,756,318 to Shannon et al., the disclosures of which are incorporated herein by reference.

Preferred smoking articles which contain a catalytic composition, particularly as part of the fuel element, contain no more than about 6 mg of carbon monoxide in the mainstream smoke, preferably no more than about 4 mg, most preferably no more than about 2 mg when smoked for at least 10 puffs under FTC conditions comprising 35 ml puff volumes of 2 seconds duration, separated by 58 seconds of smolder (hereinafter "FTC conditions").

The catalytic composition may be incorporated into the carbonaceous fuel in a number of ways. In certain preferred embodiments, formed fuel elements are prepared, e.g., by intimately mixing a carbonaceous material and a catalytic composition such as a platinum group metal and/or a ceramic material (e.g. alumina, zirconia, titania, and the like,). The ceramic material can act both as a catalytic material and/or as a support for the platinum group metals when they are employed.

In certain other preferred embodiments, the carbonaceous fuel element is formed so as to concentrate the catalytic compositions in one or more longitudinal passageways extending at least partially through the fuel element. For example, the fuel element may comprise an inner core/outer shell arrangement where the outer shell comprises a carbonaceous material surrounding the inner core, and the inner core comprises a ceramic material and/or platinum group metal, preferably having at least one longitudinal passageway extending at least partially therethrough.

The fuel element may also comprise a formed coherent mass of carbonaceous material which has applied thereto (e.g. by dipping, spraying, and the like) a solution such as a chloride solution of the platinum group metals.

In all of the above-described embodiments, it is preferred that the fuel have at least one passageway extending at least partially therethrough.

While incorporation of the catalyst onto or into the fuel element is preferred, the catalyst may also be placed in other locations of the smoking article to effect the conversion of carbon monoxide to carbon dioxide. In the preferred smoking article illustrated in FIG. 1 and described in more detail below, such alternate locations include a) between the fuel element and aerosol generating means and b) in the aerosol generating means itself.

Preferred catalytic compositions include a wide range of ceramic materials such as oxides, nitrides carbides and borides. Non-oxide ceramic materials include silicon nitride, aluminum nitride, titanium boride, boron nitride, boron carbide, silicon carbide, tungsten carbide, and the like. Preferred ceramic materials include oxides such as alumina, zirconia, titania, yttria, silica, phosphates, aluminosilicates, and amorphous oxide materials such as glasses and amorphous ceramic powders. Especially preferred ceramic materials include alumina hydroxide and products of alumina hydroxide such as transition aluminas. Other catalysts which may be used either alone, or supported on the above ceramic materials, include the platinum group metals such as platinum, palladium, rhodium, iridium, ruthenium, and the like or a base metal catalyst such as iron, manganese, vanadium, copper, nickel, cobalt, and the like. The currently most preferred catalytic composition comprise one or more of the transition aluminas, particularly alpha and theta alumina, alone, or in conjunction with palladium or platinum.

Where the catalytic composition added to the smoking articles of the present invention is one of the platinum group metals, it may either be in a supported form, or in an unsupported form, but supported forms are preferred. A supported catalytic composition is prepared by depositing by either chemical or mechanical means on some base material or "support." This support is then incorporated into the smoking article, e.g. into the fuel element of the smoking article. Typical supports for the platinum group metals include charcoal, carbon black, as well as the ceramic materials described above. A preferred support in this invention is alumina, most preferably transition aluminas.

In its most preferred embodiments, where the catalyst comprises transition alumina, the amount of catalyst added to a carbonaceous fuel element by wt. % can be as low as 2% in the preferred small (10 mm×4.5 mm) fuel elements. Where one of the platinum group metals is employed as the catalytic composition, the amount may be as low as about 5 micrograms of metal.

The catalytic composition, in whatever location selected, must be present in an amount which decreases the levels of delivered carbon monoxide in the mainstream aerosol during the burning of the fuel element.

As used herein, the term "carbonaceous" means that the material, exclusive of any catalytic compositions and non carbon-containing supports, primarily comprises carbon.

As used herein, the term "substantially free of an active metal component" means having less than about 2 micrograms of such component.

As used herein, the term "pressure formed" means formed under pressure, e.g., pressed, molded or extruded.

DETAILED DESCRIPTION OF THE PREFERRED EMBODIMENTS

Figure 1:
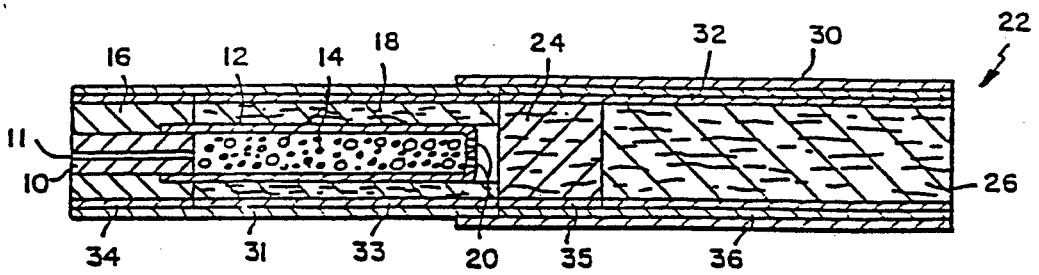
FIG. 1 is a longitudinal view of one preferred smoking article which may employ the catalyst-carbon containing fuel element of the present invention.

In accordance with the present invention there are provided smoking articles which contain a catalytic composition in one or more locations of the smoking article. The catalytic composition is advantageously employed as part of the carbonaceous fuel element of such smoking articles. These fuels are especially useful in making smoking articles that produce an aerosol containing or resembling tobacco smoke, but which contain little or no incomplete combustion or pyrolysis products. The preferred smoking articles which may employ such catalyst-carbon fuels are described in the above-referenced European Patent publication Nos. 0174645 and 0212234, and in U.S. Pat. Nos. 4,714,082 and 4,756,318.

Preferably, the catalytic composition is employed as one component of a pressure formed carbonaceous fuel element such as those described in the above-referenced EPO Publication Nos. 0174645 and 0212234, and U.S. Pat. Nos.4,714,082 and 4,756,318.

In general, the carbonaceous starting material which is used to prepare the preferred fuel elements should contain primarily carbon, hydrogen and oxygen. Preferred carbon containing materials are cellulosic materials, preferably those with a high (i.e., greater than about 80%) alpha-cellulose content, such as cotton, rayon, paper and the like.

One especially preferred high alpha-cellulose starting material is hardwood paper stock such as non-talc containing grades of Grande Prairie Canadian Kraft paper, obtained from Buckeye Cellulose Corp., Memphis, TN.

The carbon component of the fuels of the present invention is generally prepared by the pyrolysis of the starting material, at a temperature between about 400° C. to about 1300° C., preferably between about 500° C. to about 950° C., in a non-oxidizing atmosphere, for a period of time sufficient to ensure that all of the cellulose material has reached the desired carbonization temperature.

Although the pyrolysis may be conducted at a constant temperature, it has been found that a slow pyrolysis, employing a gradually increasing heating rate, e.g., at from about 1° C. to 20° C. per hour, preferably from about 5° C. to 15° C. per hour, over many hours, produces a more uniform material and a higher carbon yield.

After cooling, the carbon is pulverized, preferably to a fine powder. This powder may be subjected to a second pyrolysis or "polishing" step, wherein the carbonized particulate material, is again pyrolyzed in a non-oxidizing atmosphere, at a temperature between about 650° C. to about 1250° C., preferably from about 700° to 900° C. At this point, the carbon is ready for formation into the fuel elements for smoking articles as discussed in more detail hereinbelow.

The catalytic composition component of the preferred fuel elements include materials which substantially decrease the amount of carbon monoxide in the mainstream of a smoking article employing such fuel elements when such smoking articles are smoked under FTC conditions for at least 10 puffs.

One preferred catalytic composition comprises a ceramic material. As used herein the term "ceramic materials" includes oxides, nitrides, carbides and borides. Non-oxide ceramic materials include silicon nitride, aluminum nitride, titanium boride, boron nitride, boron carbide, silicon carbide, tungsten carbide, and the like. Preferred ceramic materials include oxides such as alumina, zirconia, titania, yttria, silica, phosphates, aluminosilicates, and amorphous oxide materials such as glasses and amorphous ceramic powders.

One especially preferred ceramic material comprise aluminas such as alumina hydroxide and products of alumina hydroxide such as transition aluminas. Transition alumina hydroxides which may be advantageously used as the catalytic composition include i) the low transition aluminas such as chi, gamma, and eta forms of alumina, ii) the high transition aluminas such as the kappa, delta and theta forms of alumina, iii) alpha alumina, iv) beta alumina such as sodium, potassium, magnesium and calcium aluminates, v) zeta aluminates such as lithium aluminates, or vi) mixtures thereof.

While many of these aluminas are available commercially, e.g., from W.R. Grace, these aluminas may also be prepared by calcining Gibbsite, Bayerite or Boehmite as described in Chapter 4 of *Oxides and Hydroxides of Alumina,* Alcoa Technical Paper No. 19, Revised (1987).

In general, aluminas useful in practicing the present invention will have a surface area (as measured by the nitrogen BET method) greater than about 0.1 $m^2/g$, preferably greater than about 1.0 $m^2/g$, and most preferably greater than about 5.0 $m^2/g$.

The pore volume of the alumina should, in general, be greater than about 0.01 cc/g, preferably greater than about 0.05 cc/g, and most preferably greater than about 0.1 cc/g, measured by, e.g., the nitrogen BET method.

The particle size of the alumina is in general less than about 500 microns preferably less than about 100 microns, and most preferably less than about 30 microns.

In general, the amount of alumina by weight percent of the fuel element is between about 1 and 60%, preferably between about 2 and 25%, and most preferably between about 4 and 15%.

The most preferred alumina is a theta alumina containing from 1 to 95% alpha alumina. One particularly preferred alumina is produced by W.R. Grace and is described in more detail in Example I.

The catalytic composition may comprise the ceramic material, and in particular alumina, either alone (e.g., substantially free of an active metal component), or it may contain a second active metal component such as one of the platinum group metals or base metal catalysts discussed below. When the ceramic material is used in conjunction with such second component, it may act as a both catalytic composition, as well as a support for the metal component of the catalytic composition. When used in conjunction with a ceramic material or other support, the amount of the platinum group metal or base metal catalyst may vary depending on the type of metal, the degree of dispersion of the metal on the ceramic material, the manner in which the metal is added, the crystalline size of the metal, porosity of the support and the particle size of the support. In general, when used with the preferred amount of transition aluminas, the amount of such second component by weight percent of the ceramic material or other support will be less than about 5%, preferably less than about 3%, and most preferably less than about 2%.

In accordance with another preferred embodiment, the catalytic composition comprises a metal component selected from the group of a platinum group metal or a base metal catalyst. The preferred platinum group metals are selected from the group of platinum, palladium, rhodium, iridium, ruthenium, or mixtures thereof. The preferred base metal catalysts are selected from the group of iron, manganese, vanadium, copper, nickel, cobalt, or mixtures thereof.

The most preferred catalytic composition of the platinum group metals or base metal catalysts are platinum and palladium.

As described above, it is preferred that these components be supported on a ceramic material such as one of the transition alumina hydroxides. The preferred platinum group metal may, however, be incorporated into the fuel in an unsupported state. In such cases, the amount of platinum group metal by weight percent of the fuel element should be less than about 1.0%, preferably less than about 0.5%, most preferably less than about 0.2%. The overall amount of platinum group metal in such smoking articles is preferably less than about 400 micrograms, most preferably less than 280 micrograms per cigarette.

The two major fuel components, the carbonaceous material and the catalytic composition may be combined or formed into a fuel in a number of ways. In one preferred embodiment, these components are admixed with a binder, water, and any desired minor components, and shaped or formed into fuel elements using extrusion or pressure forming techniques.

The binders which may be used in preparing such fuel elements are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, other cellulose derivatives, such as methylcellulose and carboxymethylcellulose (CMC), hydroxypropyl cellulose, starches, alginates, and polyvinyl alcohols.

Other materials which may be added to the fuel element include those described in the above-referenced EPO publications and U.S. Pat. Nos. 4,714,082 and 4,756,318. In addition, a minor amount of lampblack, e.g., about 10 percent, may be used as an additional source of carbon.

If desired, fuel elements containing carbon and binder may be further pyrolyzed in a non-oxidizing atmosphere after formation, for example, at from about 450° C. to 1100° C., preferably at from about 850° C. to 1000° C., for about two hours, to convert the binder to carbon. This post-formation "baking" step reduces any taste contributions which the binder may contribute to the mainstream aerosol.

In accordance with another embodiment, the fuel element comprises a pressure formed mass of carbonaceous material having at least one longitudinal passageway extending at least partially therethrough, and a catalytic composition contained at least partially within the longitudinal passageway of the carbonaceous mass. Preferably, the catalytic composition is also provided with at least one longitudinal passageway extending at least partially therethrough. This concentrated catalytic bed of material is particularly effective at decreasing the amount of carbon monoxide in the mainstream smoke as it provides a concentrated fixed controllable catalytic bed through which a majority of the combustion products must pass in order to enter into the mainstream aerosol of the smoking article.

This type of fuel having a concentrated bed of the catalytic composition may be prepared in a number of ways. For example, a fuel element comprising a pressure formed mass of carbonaceous material may be prepared as described above. This fuel may be provided with one or more longitudinal passageways into which the catalytic composition is deposited in the form of a solid rod or a paste. The catalytic composition is preferably one of the platinum group metals supported on one of the preferred alumina supports, or it may be one of the alumina materials itself. Preferably, the catalytic composition contained within the longitudinal passageway of the pressure formed mass of carbonaceous material is also provided with at least one longitudinal passageway extending at least partially therethrough.

This inner core/outer shell - type fuel element with its preferred longitudinal passageway may be formed by co-extruding the carbonaceous material along with the catalytic composition using an appropriate die.

The catalytic composition may be impregnated or otherwise applied to a fuel element comprising a pressure formed carbonaceous mass of material. As used herein, the term "impregnate" means absorbed, adsorbed, permeated, having deposited thereon. Alternatively, the fuel element may be coated with the catalytic composition.

In this embodiment, the fuel element preferably comprises a pressure formed mass of carbonaceous material, preferably having one or more longitudinal passageways extending at least partially therethrough. The formed fuel element may also have incorporated therein one of the ceramic materials described above. These fuel elements are thereafter preferably contacted with a solution of the catalytic composition. For example, a fuel element having a plurality of longitudinal passageways may be contacted with a solution of palladium chloride which is allowed to impregnate the surface of the fuel element, including the surface of the longitudinal passageways. The platinum group metal may thereafter be reduced by any suitable means such as by heating in a flowing stream of nitrogen or hydrogen or contacted with a reducing agent, such as hydrazine or sodium borohydride.

For one preferred method of applying a catalytic composition solution to a preformed fuel element having at least one longitudinal passageway, see U.S. Pat. application Ser. No. 265,882, filed Nov. 1, 1988, now U.S. Pat. No. 5,040,511, filed by Ralph Dalla Betta and others.

Preferred fuel elements of the present invention are from about 5 to 15 mm, more preferably, from about 8 to 12 mm in length, and from about 2 to 8, preferably about 4 to 6 mm in diameter. Preferably, the apparent bulk density is greater than 0.85 cc/g as measured by mercury intrusion.

As noted above, the fuel element of the present invention is preferably provided with one or more longitudinally extending passageways. These passageways help to control transfer of heat from the fuel element to the aerosol generating means, which is important both in terms of transferring enough heat to produce sufficient aerosol and in terms of avoiding the transfer of so much heat that the aerosol former is degraded. Such passageways also help provide ease of lighting.

In preferred cigarette smoking articles, fuel elements having these characteristics are sufficient to provide fuel for at least about 7 to 10 puffs, i.e., the normal number of puffs generally obtained by smoking a cigarette under FTC smoking conditions.

Figure 1A:
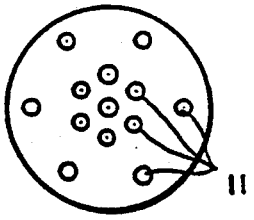
FIGS. 1A–1C are sectional views of preferred fuel element passageway configurations useful in the preferred smoking articles.
Figure 1B:
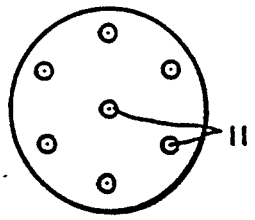
Figure 1C:
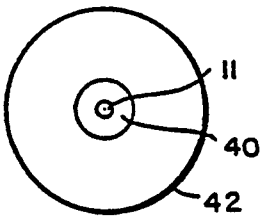

One preferred cigarette employing the catalyst-carbon fuel element of the present invention is illustrated in FIG. 1 accompanying this specification. Referring to FIG. 1, there is illustrated a cigarette having a small carbonaceous fuel element 10 with a plurality of passageways 11 therethrough, preferably arranged as shown in FIG. 1A. This fuel element is shown surrounded by a resilient jacket of insulating fibers 16, such as glass fibers. Another preferred fuel element configuration shown in FIG. 1B employs a fuel element having seven holes. Yet another fuel element configuration having an inner core 40 of catalytic composition and outer shell 42 of carbonaceous material with only one central passageway 11 is shown in FIG. 1C.

The fuel element 10 may be formed from an extruded mixture of (i) the catalytic composition and (ii) carbon (preferably from carbonized paper), lampblack, sodium carboxymethyl cellulose (SCMC) binder, $K_2CO_3$, and water, as described in greater detail below as well as in the above referenced patents and EPO publications.

Capsule 12 containing aerosol forming material 14 is circumscribed by a roll of tobacco 18. The roll of tobacco can be employed as cut filler, although other forms of tobacco can be employed. For example, the tobacco can be employed as strands or shreds of tobacco laminae, reconstituted tobacco, volume expanded tobacco, processed tobacco stems, or blends thereof. Extruded tobacco materials and other forms of tobacco, such as tobacco extracts, tobacco dust, or the like, can also be employed. Two slit-like passageways 20 are provided at the mouth end of the capsule in the center of the crimped tube.

At the mouth end of tobacco roll 18 is a mouthend piece 22, preferably comprising a cylindrical segment of a tobacco paper sheet material 24 and a segment of non-woven thermoplastic fibers 26 through which the aerosol passes to the user. The article, or portions thereof, is overwrapped with one or more layers of cigarette papers 30–36. The mouthend may also be air diluted, if desired.

Upon lighting of the aforesaid smoking article, the fuel element 10 burns, generating the heat used to volatilize the aerosol generating means 12. During burning, the preferred carbon fuel typically produces three main combustion products, water, carbon dioxide and carbon monoxide. With a catalytic composition present in the fuel, much of the carbon monoxide produced by the incomplete combustion of the carbon interacts with oxygen from the incoming air in the presence of catalyst and the catalyst, and is converted to carbon dioxide.

Ultimately, a smoke-like aerosol, with little or no carbon monoxide, passes out of capsule 12 through slit-like passageways 20, where it mixes with tobacco flavor components of the tobacco roll. These materials then pass through the mouthend piece 22 and to the user.

While direct placement of the catalytic composition in the fuel element is preferred, the catalytic composition may be placed in other locations in the smoking article to effect the conversion of carbon monoxide to carbon dioxide. Referring to the preferred smoking article depicted in FIG. 1, the catalytic composition may be advantageously located between the fuel element 10 and the aerosol forming materials 14, and/or mixed with aerosol forming materials 14, where the catalytic composition is exposed to elevated temperatures during smoking, e.g., in excess of about 100° C. The catalytic compositions can also be placed both in the fuel element and in other locations.

The present invention will be further illustrated with reference to the following examples which will aid in the understanding of the present invention, but which are not to be construed as limitations thereof. All percentages reported herein, unless otherwise specified, are percent by weight. All temperatures are expressed in degrees Celsius. Except where otherwise indicated, carbon monoxide and carbon dioxide measurements were made as described in the above referenced RJR Monograph.

EXAMPLE I

A smoking article of the type illustrated in FIG. 1 was made in the following manner:

A. Fuel Source Preparation

Two fuel elements (10 mm long, 4.5 mm o.d.) having an apparent density of about 0.9 cc/g were prepared from hardwood pulp carbon (79 wt. %), SCMC binder (10 wt. %), $K_2CO_3$ (1 wt. %) and catalytic composition (10 wt. %)

The catalytic composition in the first fuel element is a theta alumina powder prepared by calcining Gibbsite to about 1120° C. This material is available from Davison Chemical Division of W.R. Grace and Company, Columbia, Maryland under designation No. SMR-37-35. It has a surface area of 79 $m^2/g$ and a pore volume of about 0.3 cc/g, as measured by $N_2$ BET. Powder X-Ray diffraction analysis revealed that the material was comprised of 94% of the theta form of alumina and 6% of the alpha form of alumina. The average particle size was 5.5 micron by volume.

The catalytic composition in the second fuel element was comprised of the same theta alumina powder described above onto which was loaded palladium (0.5 wt. %). This loaded material was also provided by W.R. Grace and Company under designation No. SMR-37-35.

The hardwood pulp carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the paper carbon was ground to a mesh size of minus 200 (U.S.).

After again cooling under nitrogen to less than about 35° C., the paper carbon was ground to a fine powder, i.e., a powder having an average particle size of from about 0.1 to 50 microns.

This fine paper carbon powder was admixed with the catalytic composition, Hercules 7HF SCMC binder and $K_2CO_3$ in the weight ratios set forth above, together with sufficient water to make a stiff, dough-like paste.

Fuel elements were extruded from this paste having seven axial holes each about 0.6 mm in diameter. Six holes were equally spaced about the center of the fuel element on a 1.6 mm bolt radius. The seventh hole was directly in the center.

These fuel elements were baked-out under a nitrogen atmosphere at 950° C. for about ½ hour. The final dry weight of both fuel elements was about 150 mg. The final weight of palladium in the second fuel element was about 0.072 mg.

B. Spray Dried Extract

A blend of flue cured tobaccos were ground to a medium dust and extracted with water in a stainless steel tank at a concentration of from about 1 to 1.5 pounds tobacco per gallon water The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, an Anhydro Size No 1, at an inlet temperature of from about 215°–230° C. and collecting the dried powder material at the outlet of the drier. The outlet powder material at the outlet of the drier. The outlet temperature varied from about 82°–90° C.

C. Preparation of Sintered Alumina

High surface area alumina (surface area of about 280 $m^2/g$) from W.R. Grace & Co., having a mesh size of from −14 to +0 (U.S.) was sintered at a soak temperature of about 1400° C. to 1550° C. for about one hour, washed with water and dried This sintered alumina was combined, in a two step process, with the ingredients shown in Table I in the indicated proportions:

TABLE I

| | |
|---|---|
| Alumina | 68.11% |
| Glycerin | 19.50% |
| Spray Dried Extract | 8.19% |
| HFCS (Invertose) | 3.60% |
| Abstract of Cocoa | 0.60% |

TABLE I-continued

| | |
|---|---|
| Total | 100.0% |

In the first step, the spray dried tobacco extract was mixed with sufficient water to form a slurry. This slurry was then applied to the alumina carrier described above by mixing until the slurry was uniformly absorbed by the alumina. The treated alumina was then dried to reduce the moisture content to about 1 wt. %. In the second step, this treated alumina was mixed with a combination of the other listed ingredients until the liquid was substantially absorbed within the alumina carrier.

D. Assembly

The capsule used to construct the FIG. 1 cigarette was prepared from deep drawn aluminum. The capsule had an average wall thickness of about 0.004 in. (0.1 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user.

About 330 mg of the aerosol producing substrate described above was used to load the capsule. A fuel element prepared as above, was inserted into the open end of the filled capsule to a depth of about 3 mm.

E. Insulting Jacket

The fuel element - capsule combination was overwrapped at the fuel element with a 10 mm long, glass fiber jacket of Owens-Corning 6437 glass with 3 weight percent pectin binder, to a diameter of about 7.5 mm. The glass jacket was then wrapped with an innerwrap material from Kimberly-Clark designate P78-63-5.

F. Tobacco Roll

A 7.5 mm diameter tobacco roll (28 mm long) with an overwrap of Kimberly-Clark's P1487-125 paper was modified by insertion of a probe to have a longitudinal passageway of about 4.5 mm diameter therein.

G. Assembly

The jacketed fuel element - capsule combination was inserted into the tobacco roll passageway until the jacket of insulating material abutted the tobacco. The jacket of insulating material and the tobacco roll sections were joined together by an outerwrap material which circumscribed both the fuel element/insulating jacket/innerwrap combination and the wrapped tobacco roll. The outerwrap was a Kimberly-Clark paper designated P1768-182.

H. Mouthend Piece Assembly

A mouthend piece of the type illustrated in FIG. 1, was constructed by combining two sections: (1) a 10 mm long, 7.5 mm diameter segment of folded tobacco sheet material (Kimberly-Clark Designation No. P144-185-GAPF) adjacent the capsule, overwrapped with Kimberly-Clark's P850-184-2 paper and (2) a 30 mm long, 7.5 mm diameter cylindrical segment of a folded non-woven meltblown thermoplastic polypropylene web obtained from Kimberly-Clark Corporation, designated P-100-F, overwrapped with Kimberly-Clark's P1487-184-2 paper.

These two sections were combined with a combining overwrap of Kimberly-Clark's P850-186-2 paper.

I. Final Assembly

The combined mouthend piece section was joined to the jacketed fuel element—capsule section by a final overwrap of Ecusta's 30637-801-12001 tipping paper.

The resulting models were smoked by under FTC conditions for 10 puffs. This consisted of 2 second 35 ml puffs separated by a 58 second smolder periods. The results of the mainstream CO and $CO_2$ delivery were compared to a control model. The control was prepared in an identical fashion except that the fuel composition contained no catalytic material, i.e., 89% carbon, 10% SCMC and 1% $K_2CO_3$.

The mainstream smoke of the smoking article with the fuel element containing 10 wt. % theta alumina contained 2.3 mg CO and 36 mg $CO_2$. The fuel with 10% wt. % theta alumina onto which was loaded 0.5% palladium generated a mainstream smoke which contained 1.0 mg CO and 36 mg $CO_2$. The control contained 9.6 mg CO and 43 mg $CO_2$. These results clearly show that the fuels with catalytic material deliver significantly lower CO.

EXAMPLE II

Fuels were prepared in the same manner as described in Example I except that they contained 5% wt. % Type 207 alumina from Degussa Corporation, South Plainfield, NJ. This alumina had a surface area of 344 $m^2/g$ and a pore volume of 0.31 CC/g as measured by $N_2$ BET. The particle size was 2–15 microns.

Palladium was added to the formed and baked fuels by dipping them into an acidic salt solution of palladium. The dry weight percent of palladium metal on these fuels was 0.05, 0.16 and 0.50. The fuel elements were then dried and the palladium was reduced to the metallic state.

The fuels were used in smoking articles as described in Example I and analyzed for CO and $CO_2$ The results of the CO and $CO_2$ analysis are given in Table II.

TABLE II

| wt % of Palladium in Fuel | wt. % of Alumina in fuel | CO mg | $CO_2$ mg |
|---|---|---|---|
| 0 | 0 | 9.6 | 43 |
| 0 | 5 | 6.2 | 50 |
| .05 | 5 | 4.7 | 48 |
| .16 | 5 | 4.0 | 49 |
| .50 | 5 | 2.1 | 54 |

These results clearly show that the CO decreases from 9.6 to 6.2 mg when 5% alumina is added to the fuel element. Further reduction can be achieved, however, when palladium is added to the formed and baked fuel. As low as 2.1 mg of CO has been obtained from a fuel with 0.50% by wt. palladium.

EXAMPLE III

A smoking article similar to that shown in FIG. 1 was made in the following manner except that a fuel having an outer shell of carbonaceous material and an inner core of a catalytic composition was prepared as follows:

The outer shell of the fuel element (10 mm long, 4.5 mm o.d.) having an apparent (bulk) density of about 0.86 cc/g, was prepared from hardwood pulp carbon (89 wt. %), SCMC binder (10 wt. %) and $K_2CO_3$ (1 wt. %).

The hardwood pulp carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the paper carbon was ground to a fine powder, i.e., a powder having an average particle size of from about 0.1 to 50 microns.

This fine paper carbon powder was admixed with the Hercules 7HF SCMC binder and $K_2CO_3$ in the weight ratios set forth above, together with fuel elements were extruded either with: 1) no peripheral holes—a central single hole was drilled by hand with a diameter of about 2.29 mm (0.090") (after baking); 2) a single central hole with a diameter of about 2.29 mm (0.090"); or 3) a single central hole with a diameter of about 2.29 mm (0.090") plus 6 peripheral holes each with a diameter of about 0.25 mm (0.010"). These fuel elements were then baked-out under a nitrogen atmosphere at 950° C. for 3 hours after formation. The inner core material was prepared in the following manner:

| | |
|---|---|
| A) The below ingredients were mixed either by hand or in a high shear mixer with sufficient water to make a flowable paste (e.g., about 40–50% moisture) | |
| 10% | alpha alumina with .5% pd |
| 10% | SCMC binder |
| 3% | $K_2CO_3$ |
| 5% | calcium oxalate |
| 35% | Ethyl cellulose |
| 3% | Hollow glass microspheres (70 microns) |
| 24% | carbon |
| 10% | Carbonized cotton linters |
| B) Inner core material also prepared as described above except the following ingredients were used: | |
| 10% | alpha alumina with .5% Pd |
| 10% | CMC |
| 80% | carbon |

For both innercore preparations A and B, the paste was extruded into a rod having a diameter of about 2.24 mm (0.088") having a single central passageway of about 1 mm diameter. The cores that were extruded were allowed to dry at room temperature for 24 hours. They were then cut to 10 mm lengths and placed inside an unbaked carbon fuel through a single central hole. The fuels were then baked under nitrogen for 3 hours at 950° C.

In addition, the A and B pastes were also placed in a syringe and squirted into an unbaked carbon fuel having a single central hole with, and without additional peripheral holes, and baked for 3 hours under nitrogen at 950° C.

Mainstream CO for fuels made from preparation A in models similar to those described in Example I were about 2.8 mg under FTC conditions.

Mainstream CO for fuels similar to preparation B in models similar to those descried in Example I was about 1.3 mg under FTC conditions.

EXAMPLE IV

Two fuel elements were prepared as described in Example I except that they were prepared from hardwood pulp carbon (79 wt. %), SCMC (10 wt. %), $K_2CO_3$ (1 wt. %) and catalytic composition (10 wt. %). The catalytic composition of one fuel was silica designated MP-680 obtained from Kali-Chemie Corporation, Greenwich, CT. This material had a pore diameter of 0.68 mm. The catalytic composition in the other fuel was silicon nitride approximately 0.1 microns in diameter obtained from UBE Industries of Japan, designated UBE-SN-E10, Lot A710-492. These two fuel elements were made into models and tested as described in Example I. Models with fuel elements containing the silica contained 5.6 mg CO and 33 mg $CO_2$ while models containing the silicon nitride contained 3.1 mg CO and 35 mg $CO_2$. The control contained 9.6 mg CO and 43 mg $CO_2$.

EXAMPLE V

Fuels were prepared as described in Example I except that the level of alumina was varied from 5 to 25 weight percent of the fuel. The alumina was type A-16 SG supplied by Alcoa Chemicals Division of Aluminum Company of America, Pittsburgh, PA. This alumina had a particle size of 0.3 microns to 0.5 microns and a surface area of 10 $m^2/g$. X-Ray diffraction revealed that the material was alpha alumina. The fuel elements were comprised of 10 wt. % SCMC, 1 wt. % $K_2CO_3$ and the remaining 80% made up by hardwood pulp carbon and alumina. Alumina levels of 5, 10, 15, 25 weight percent were prepared which had the corresponding carbon concentrations of 84, 79, 74 and 64 weight percent, respectively. These fuel elements were prepared and evaluated as described in Example I.

The mainstream CO and $CO_2$ contents are given in Table II compared to a control which contained no alumina.

TABLE II

EFFECT OF ALUMINA LEVEL IN FUEL ON CO

| Alumina (Alpha) | | FTC | |
|---|---|---|---|
| % | Type | CO | $CO_2$ |
| 0 | Control | 11.7 | 43 |
| 5 | A-16SG (Alcoa), 0.5 microns | 6.5 | 43 |
| 10 | A-16SG (Alcoa), 0.5 microns | 3.8 | 43 |
| 15 | A-16SG (Alcoa), 0.5 microns | 2.6 | 35 |
| 25 | A-16SG (Alcoa), 0.5 microns | 2.3 | 41 |

EXAMPLE VI

A fuel element was made as described in Example I except that it was contained 10% alumina obtained from Degussa Corporation and designated type A-1. The surface area of this alumina was 130 $m^2/g$ and the pore volume was 0.17 cc/g. The material appeared to be amorphous when analyzed by powder X-ray diffraction.

The formed and baked fuel elements were soaked in 0.05% aqueous solution of tetramine palladium (II) nitrate, PD $(NH_3)_4(NO_3)_2$. The solution also contained 1.0% $Na_2CO_3$ and 0.5% $K_2CO_3$. The fuels were soaked for 3 hours, removed and heated at 300° C. to decompose the palladium complex to the metallic state.

The resulting fuels were made into models and analyzed for CO and $CO_2$ as described in Example 1. The CO contained in the mainstream smoke of such smoking articles was 2.4 mg and $CO_2$ was 45 mg. Similar fuels not treated with palladium contained 5.3 mg CO.

EXAMPLE VII

Smoking articles employing a fuel element-capsule arrangement similar to those described in Example I were prepared except that the catalytic composition was impregnated onto alumina beads and placed immediately behind the fuel element. The alumina-impregnated beads were prepared as follows:

High surface area alumina beads, similar to those described in Example I for carrying the aerosol forming material, were sintered at 1000° C. for one hour, washed with water and dried, and sieved through a 0.063" (1.6 mm) diameter perforated stainless steel grid. These beads were impregnated with 0.6 wt. % palladium as follows: $PdCl_2$ was dissolved in 50/50 isopropyl alcohol/water; the beads were exchanged in this solution for one hour, dried, and reduced in a $NaBH_4$ solution. The impregnated beads were placed immediately behind the fuel element.

The mainstream smoke of smoking articles employing alumina beads behind the fuel element containing 0.2 mg of paladium contained less than 2.5 mg of CO as measured by a Beckman Infrared Analyzer.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A fuel element for smoking articles comprising:

a) a pressure formed mass of carbonaceous material; and b) a catalytic composition comprising a ceramic material which is an oxide selected from the group of alumina, zirconia, titania, yttria, silica, phosphates, aluminosilicates, or mixtures thereof, which during burning of the fuel element substantially decreases the amount of carbon monoxide in the mainstream smoke of a smoking article employing the fuel element.

2. The fuel element of claim 1, wherein the the catalytic composition comprises alumina selected from the group of alumina hydroxide and transition aluminas.

3. The fuel element of claim 2, wherein the transition aluminas are selected from the group of low transition aluminas, high transition aluminas, alpha alumina, beta alumina, zeta alumina or mixtures thereof.

4. The fuel element of claim 3, wherein the low transition alumina is selected from the group of chi, gamma and eta forms of alumina, and the high transition alumina is selected form the group of kappa, delta and theta forms of alumina.

5. The fuel element of claim 2, wherein the surface area of the alumina is greater than about 0.1 $m^2/g$.

6. The fuel element of claim 2, wherein the surface area of the alumina is greater than about 1.0 $m^2/g$.

7. The fuel element of claim 2, wherein the surface area of the alumina is greater than about 5.0 $m^2/g$.

8. The fuel element of claim 2, wherein the pore volume of the alumina is greater than about 0.01 cc/g.

9. The fuel element of claim 2, wherein the pore volume of the alumina is greater than bout 0.05 cc/g.

10. The fuel element of claim 2, wherein the pore volume of the alumina is greater than about 0.1 cc/g.

11. The fuel element of claim 1, wherein the amount of ceramic material by weight percent of the fuel element is between about 1 and 60%.

12. The fuel element of claim 1, 2 or 3, wherein the catalytic composition further comprises an active metal component supported on the ceramic material, wherein the metal component is selected from the group of platinum group metals and base metals.

13. The formed fuel element of claim 12, wherein the platinum group metal is selected from the group of platinum, palladium, rhodium, iridium, ruthenium, or mixtures thereof, and the base metal is selected from the group of iron, manganese, vanadium, copper, nickel, cobalt, or mixtures thereof.

14. The fuel element of claim 13, wherein the metal component is a platinum group metal and the amount of platinum group metal by weight percent of the support is less than about 5%.

15. The fuel element of claim 13, wherein the metal component is platinum group metal and the amount of platinum group metal by weight percent of the support is less than about 3%.

16. The fuel element of claim 13, wherein the metal component is a platinum group metal and the amount of platinum group metal by weight percent of the support is less than about 2%.

17. The fuel element of claim 1, wherein the catalytic composition comprises a metal component selected from the group of platinum group metal and a base metal.

18. The fuel element of 17, wherein the platinum group metal is selected form the group of platinum, palladium, rhodium, iridium, ruthenium, or mixtures thereof, and the base metal is selected from the group of iron, manganese, vanadium, copper, nickel, cobalt, or mixtures thereof.

19. The fuel element of claim 18, wherein the metal component is a platinum group metal and the amount of platinum group metal by weight percent of the fuel element is less than about 1.0%.

20. The fuel element of claim 18, wherein the amount of platinum group metal by weight percent of the fuel element is less than about 0.5%.

21. The fuel element of claim 18, wherein the amount of platinum group metal by weight percent of the fuel element is less than about 0.2%.

22. The fuel element of claim 18, 19, or 20 wherein the fuel contains less than about 280 micrograms of the platinum group metal.

23. A fuel element for smoking articles comprising:

a) a pressure formed mass of carbonaceous material having at least one longitudinal passageway extending at least partially therethrough; and b) a catalytic composition comprising a ceramic material which is an oxide selected from the group of alumina, zirconia, titania, yttria, silica, phosphates, aluminosilicates, or mixtures thereof, wherein the catalytic composition is contained at least partially within the longitudinal passageway, and which during burning of the fuel element substantially decreases the amount of carbon monoxide in the mainstream smoke of a smoking article employing the fuel element.

24. The fuel element of claim 23, wherein the the catalytic composition comprises alumina selected from the group of alumina hydroxide and transition aluminas.

25. The formed fuel element of claim 24, wherein the transition aluminas are selected from the group of low transition aluminas, high transition aluminas, alpha alumina, beta alumina, zeta alumina or mixtures thereof.

26. The formed fuel element of claim 25, wherein the low transition alumina is selected from the group of chi, gamma and eta forms of alumina, and the high transition alumina is selected form the group of kappa, delta and theta forms of alumina.

27. The fuel element of claim 24, wherein the surface area of the alumina is greater than about 0.1 $m^2/g$.

28. The fuel element of claim 24, wherein the pore volume of the alumina is greater than about 0.01 cc/g.

29. The fuel element of claim 23, 24, 25 or 26, wherein the catalytic composition further comprises a platinum group metal supported on the ceramic material.

30. The fuel element of claim 29, wherein the platinum group metal is selected from the group of platinum, palladium, rhodium, iridium, ruthenium, or mixtures thereof.

31. The fuel element of claim 30, wherein the amount of platinum group metal by weight percent of the ceramic material is less than about 5%.

32. The fuel element of claim 31, wherein the metal component is platinum group metal catalyst and the amount of platinum group metal by weight percent of the ceramic material is less than about 3%.

33. The fuel element of claim 31, wherein the metal component is a platinum group metal catalyst and the amount of platinum group metal by weight percent of the ceramic material is less than about 2%.

34. A fuel element for smoking articles comprising a pressure formed mass of carbonaceous material impregnated with a catalytic composition comprising a ceramic material selected from the group of oxides, nitrides, carbides or borides which during burning of the fuel element substantially decreases the amount of carbon momoxide in the mainstream smoke of a smoking article employing the fuel element.

35. The fuel element of claim 34, wherein the ceramic material comprises an oxide selected from the group of alumina, zirconia, titania, yttria, silica, phosphates, aluninosilicates, and silicon nitride.

36. The fuel element of claim 35, wherein ceramic material comprises alumina selected from the group of alumina hydroxide and transition aluminas.

37. The fuel element of claim 36, wherein the surface area of the alumina is greater than about 0.1 $m^2/g$.

38. The fuel element of claim 36, wherein the pore volume is greater than about 0.01 cc/g.

39. The fuel element of claim 34, wherein, the amount of ceramic material by weight percent of the element is between about 1 and 60%.

40. The fuel element of claim 34, 46, 47, 48, 49 or 50, further comprising at least one longitudinal passageway extending at least partially therethrough, wherein at least the surface of the longitudinal passageway is impregenated with the catalytic composition.

41. The fuel element of claim 40, wherein the catalytic composition comprises a platinum group metal selected/form the group of platinum, palladium, rhodium, iridium, ruthenium or mixtures thereof.

42. The fuel element of claim 41, wherein the amount of platinum group metal by weight percent of the fuel element is less than about 1.0%.

43. The fuel element of claim 41, wherein the amount of platinum group metal by weight percent of the fuel element is less than about 0.5%.

44. The fuel element of claim 41, wherein the amount of platinum group metal by weight percent of the fuel element is less than about 0.2%.

45. A smoking article comprising:

a) a fuel element comprising a pressure formed mass of carbonaceous material and a catalytic composition comprising a ceramic material selected from the group of oxides, nitrides, carbides, or borides which during burning of the fuel element substantially decreases the amount of carbon monoxide in the mainstream smoke of the smoking article; and b) a physically separate aerosol generating means including an aerosol forming material.

46. The smoking article of claim 45, wherein the ceramic material comprises an oxide selected from the group of alumina, zirconia, titania, yttria, silica, phosphates, aluminosilicates, or mixtures thereof.

47. The smoking article of claim 46, wherein the catalytic composition comprises alumina selected from the group of alumina hydroxide and transition aluminas.

48. The smoking article of claim 47, wherein the transition aluminas are selected from the group of low transition aluminas, high transition aluminas, alpha alumina, beta alumina, zeta alumina or mixtures thereof.

49. The smoking article of claim 48, wherein the low transition alumina is selected from the group of chi, gamma and eta forms of alumina, and the high transition alumina is selected form the group of kappa, delta and theta forms of alumina.

50. The smoking article of claim 47, wherein the surface area of the alumina is greater than about 0.1 $m^2/g$.

51. The smoking article of claim 47, wherein the surface area of the alumina is greater than about 1.0 $m^2/g$.

52. The smoking article of claim 47, wherein the surface area of the alumina is greater than about 5.0 $m^2/g$.

53. The smoking article of claim 47, wherein the pore volume of the alumina is greater than about 0.01 cc/g.

54. The smoking article of claim 47, wherein the pore volume of the alumina is greater than about 0.05 cc/g.

55. The smoking article of claim 47, wherein the pore volume of the alumina is greater than about 0.1 cc/g.

56. The smoking article of claim 45, wherein the amount of ceramic material by weight percent of the fuel element is between about 1 and 60%.

57. The smoking article of claim 45, wherein the amount of ceramic material by weight percent of the fuel element is between about 2 and 25%.

58. The smoking article of claim 45, wherein the amount of ceramic material by weight percent of the fuel element is between about 4 and 15%.

59. The smoking article of claim 45, 46, 47 or 48, wherein the catalytic composition further comprises a metal component supported on the ceramic material selected from the group of platinum group metals and base metals.

60. The smoking article of claim 59, wherein the platinum group metal is selected from the group of platinum, palladium, rhodium, iridium, ruthenium, or mixtures thereof, and the base metal is selected from the group of iron, manganese, vanadium, copper, nickel, cobalt, or mixtures thereof.

61. The smoking article of claim 59, wherein the metal component is a platinum group metal and the amount of platinum group metal by weight percent of the support is less than about 5%.

62. The smoking article of claim 59, wherein the metal component is platium group metal and the amount of platinum group metal by weight percent of the support is less than about 3%.

63. The smoking article of claim 59, wherein the metal component is a platinum group metal and the amount of platinum group metal by weight percent of the support is less than about 2%.

64. The smoking article of claim 60, 61, 62, or 63, wherein the fuel contains less than about 280 micrograms of the platinum group metal.

65. The smoking article of claim 45, wherein the catalytic composition comprises a metal component selected from the group of a platinum group metal and a base metal.

66. The smoking article of claim 65, wherein the platinum group metal is selected form the group of platinum, palladium, rhodium, iridium, ruthenium, or mixtures thereof, and the base metal is selected from the group of iron, manganese, vanadium, copper, nickel, cobalt, or mixtures thereof.

67. The smoking article of claim 65, wherein the amount of platinum group metal by weight percent of the fuel element is less than about 1.0%.

68. The smoking article of claim 65, wherein the amount of platinum group metal by weight percent of the fuel element is less than about 0.5%.

69. The smoking article of claim 65, wherein the amount of platinum group metal by weight percent of the fuel element is less than about 0.2%.

70. The smoking article of claim 67, 68, or 69, wherein the fuel contains less than about 280 micrograms of the platinum group metal.

71. A smoking article comprising:

a) a pressure formed mass of carbonaceous material impregnated with a catalytic composition comprising a ceramic material which is an oxide selected from the group of alumina, zirconia, titania, yttria, silica, phosphates, aluninosilicates, or mixtures thereof which during burning of the fuel element substantially decreases the amount of carbon monoxide in the mainstream smoke of the smoking article; and b) a physically separate aerosol generating means including an aerosol forming material.

72. The smoking article of claim 71, wherein ceramic material comprises alumina selected from the group of alumina hydroxide and transition aluminas.

73. The smoking article of claim 72, wherein the surface area of the alumina is greater than about 0.1 $m^2/g$.

74. The smoking article of claim 72, wherein the pore volume is greater than about 0.01 cc/g.

75. The smoking article of claim 71, wherein the amount of ceramic material by weight percent of the element is between about 1 and 60%.

76. The smoking article of claim 71, 72, 73, 74 or 75, further comprising at least one longitudinal passageway extending at least partially therethrough, wherein at least the surface of the longitudinal passageway is impregnated with the catalytic composition.

77. The smoking article of claim 76, wherein the catalytic composition comprises a platinum group metal selected from the group of platinum, palladium, rhodium, iridium, ruthenium or mixtures thereof.

78. The smoking article of claim 77, wherein the amount of platinum group metal by weight percent of the fuel element is less than about 1.0%.

79. The smoking article of claim 77, wherein the amount of platinum group metal by weight percent of the fuel element is less than about 0.5%.

80. The smoking article of claim 77, wherein the amount of platinum group metal by weight percent of the fuel element is less than about 0.2%.

81. A smoking article comprising:

a) a carbonaceous fuel element; and b) a physically separate aerosol generating means including an aerosol forming material and a catalytic composition which during smoking decreases the amount of carbon monoxide in the mainstream smoke of the smoking article.

82. The smoking article of claim 80 or 81, wherein the catalytic composition comprises a ceramic material selected from the group of oxides, nitrides, carbides or borides.

83. The smoking article of claim 82 wherein ceramic material comprised oxide selected from the group of alumina, zirconia, titania, yttria, silica, phosphates, aluminosilicates, or mixtures thereof.

84. The smoking article of claim 83, wherein the the catalytic composition comprises alumina selected from the group of alumina hydroxide and transition aluminas.

85. The smoking article of claim 84, wherein the transition aluminas are selected from the group of low transition aluminas, high transition aluminas, alpha alumina, beta alumina, zeta, or mixtures thereof.

86. The smoking article of claim 84, wherein the low transition alumina is selected from the group of chi, gamma and eta forms of alumina, and the high transition alumina is selected form the group of kappa, delta and theta forms of alumina.

87. The smoking article of claim 86, wherein the surface area of the alumina is greater than about 0.1 $m^2/g$.

88. The smoking article of claim 86, wherein the pore volume is greater than about 0.01 cc/g.

89. The smoking article of claim 70 or 72, wherein the catalytic composition comprises a platinum group metal selected form the group of platinum, palladium, rhodium, iridium, ruthenium or mixtures thereof.

90. The smoking article of claim 45, 46, 50, 53, 56, 65, 67, 71, 73, 75 or 81 wherein the amount of carbon monoxide contained in the mainstream smoke of the smoking article when the smoking article is smoked for at least 10 puffs using 35 ml puff volumes of 2 seconds duration, separated by 58 seconds of smolder, is less than about 6 mg.

91. The smoking article of claim 90, wherein the amount of carbon monoxide contained in the mainstream smoke of the smoking article when the smoking article is smoked for at least 10 puffs using 35 ml puff volumes of 2 seconds duration, separated by 58 seconds of smolder, is less than about 4 mg.

92. The smoking article of claim 90, wherein the amount of carbon monoxide contained in the mainstream smoke of the smoking article when the smoking article is smoked for at least 10 puffs using 35 ml puff volumes of 2 seconds duration, separated by 58 seconds of smolder, is less than about 2 mg.

93. A method for preparing a fuel element for a smoking article comprising:

a) forming a mass of carbonaceous material having at least one longitudinal passageway extending at least partially therethrough; and b) applying a catalytic composition to at least a portion of the surface of the fuel element.

94. The method of claim 93, wherein mass of carbonaceous material is provided with a plurality of longitudinal passageways extending at least partially therethrough.

95. The method of claim 93 or 94, wherein the catalytic composition is applied to at least the surface of the longitudinal passageways.

96. The method of claim 93 or 94, wherein the catalytic composition is applied to the mass of carbonaceous material by impregnation.

97. The method claim 93 or 94, wherein the pressure formed mass of carbonaceous material further comprises a ceramic material selected from the group of oxides, nitrides, carbides or borides.

98. The smoking article of 97, wherein the ceramic material comprises an oxide selected from the group of alumina, zirconia, titania, yttria, silica, phosphates, aluminosilicates, and silicon nitride.

99. The method claim 98, wherein ceramic material comprises alumina selected from the group of alumina hydroxide and transition aluminas.

100. The method of claim 99, wherein the surface area of the alumina is greater than about 0.1 $m^2/g$.

101. The method of claim 99, wherein the pore volume is greater than about 0.01 cc/g.

102. The method of claim 99, wherein the amount of ceramic material by weight percent of the element is between about 1 and 60%.

103. The method of claim 93 or 94, wherein the catalytic composition comprises a platinum group metal selected from the group of platinum, palladium, rhodium, iridium, ruthenium or mixtures thereof.

104. The method of claim 103, wherein the amount of platinum group metal by weight percent of the fuel element is less than about 1.0%.

105. The method of claim 102, wherein the amount of platinum group metal by weight percent of the fuel element is less than about 0.5%.

106. The method of claim 102, wherein the amount of platinum group metal by weight percent of the fuel element is less than about 0.2%.

* * * * *

UNITED STATES PATENT AND TRADEMARK OFFICE

CERTIFICATE OF CORRECTION

PATENT NO. : 5,211,684

DATED : May 18, 1993

INVENTOR(S) : Michael D. Shannon et al.

It is certified that error appears in the above—identified patent and that said Letters Patent is hereby corrected as shown below:

Col. 15, line 55, "form" should be --from--.

Col. 15, line 66, "bout" should be --about--.

Col. 15, line 54, "form" should be --from--.

Col. 16, line 32, "form" should be --from--.

Col. 17, line 6, "form" should be --from--.

Col. 17, line 54, "46, 47, 48, 49 or 50" should be -- 35, 36, 37, 38 or 39--.

Col. 17, line 61, "form" should be --from--.

Col. 18, line 28, "form" should be --from--.

Col. 19, line 17, "form" should be --from--.

Col. 20, line 41, "form" should be --from--.

Signed and Sealed this

Twenty-fourth Day of January, 1995

Bruce Lehman

*Attest:*

BRUCE LEHMAN

*Attesting Officer*

*Commissioner of Patents and Trademarks*